US005980139A

United States Patent [19]

Chapman et al.

[11] Patent Number: 5,980,139

[45] Date of Patent: Nov. 9, 1999

[54] METHOD OF SPEED CONTROL FOR IMAGING SYSTEM INCLUDING PRINTERS WITH INTELLIGENT OPTIONS

[75] Inventors: Danny Keith Chapman, Nicholasville; Steven Wayne Parish, Lexington; Kevin Dean Schoedinger, Nicholasville, all of Ky.

[73] Assignee: Lexmark International, Inc., Lexington, Ky.

[21] Appl. No.: 09/066,006

[22] Filed: Apr. 24, 1998

[51] Int. Cl.[6] ..... B41J 11/42

[52] U.S. Cl. ..... 400/582; 400/583

[58] Field of Search ..... 400/582, 583, 400/74, 636

[56] References Cited

U.S. PATENT DOCUMENTS

| | | | |
|---|---|---|---|
| 3,938,641 | 2/1976 | Fulton | 197/1 R |
| 3,990,559 | 11/1976 | Martin et al. | 197/1 R |
| 4,275,968 | 6/1981 | Irwin | 400/582 |
| 4,277,191 | 7/1981 | Davis et al. | 400/582 |
| 4,287,461 | 9/1981 | Promis et al. | 318/571 |
| 4,459,525 | 7/1984 | Hasegawa | 318/561 |
| 4,538,933 | 9/1985 | Imaizumi et al. | 400/582 |
| 4,556,959 | 12/1985 | Allen et al. | 364/900 |
| 4,775,945 | 10/1988 | Cavill et al. | 364/519 |
| 4,777,609 | 10/1988 | Cavill et al. | 364/519 |
| 5,077,680 | 12/1991 | Sturm et al. | 395/105 |
| 5,104,110 | 4/1992 | Haibara | 271/9 |
| 5,185,627 | 2/1993 | Hartman | 355/204 |
| 5,291,114 | 3/1994 | Shirotori et al. | 318/685 |
| 5,442,382 | 8/1995 | Pfeuffer | 346/136 |
| 5,446,355 | 8/1995 | Janosky et al. | 318/661 |
| 5,467,434 | 11/1995 | Hower, Jr. et al. | 395/114 |
| 5,471,928 | 12/1995 | Dimur et al. | 101/325 |
| 5,520,383 | 5/1996 | Amagai et al. | 400/582 |
| 5,788,383 | 8/1998 | Harada et al. | 400/185 |

*Primary Examiner*—John Hilten
*Attorney, Agent, or Firm*—John A. Brady

[57] ABSTRACT

A method of controlling a speed of a print medium through a printer includes the step of providing a print medium transport assembly with a range of print medium transport speeds between a minimum print medium transport speed and a maximum print medium transport speed. A print engine is provided with a print engine speed. The range of print medium transport speeds is divided into subranges of print medium transport speeds. A requested speed is provided to the print medium transport assembly which corresponds to the print engine speed. For each subrange, an acceleration profile control equation, a constant speed control equation, and a deceleration profile control equation is determined. The constant speed control equation is dependent upon the requested speed. One of the subranges of print medium transport speeds is identified which encompasses the requested speed. The print medium is transported through the print medium transport assembly according to the acceleration profile control equation, the constant speed control equation, and the deceleration profile control equation associated with the selected subrange.

19 Claims, 3 Drawing Sheets

METHOD OF SPEED CONTROL FOR IMAGING SYSTEM INCLUDING PRINTERS WITH INTELLIGENT OPTIONS

BACKGROUND OF THE INVENTION

1. Field of the Invention

The present invention relates to imaging systems with printers and optional support devices therefor, and more particularly relates to printers, such as laser printers, having options (e.g., paper handling devices) which contain electronic intelligence for carrying out local option functions commanded by the printer.

2. Description of the Related Art

Imaging, or printing, systems typically include a base printer, which places marks (i.e., prints) on print receiving media (e.g., paper) and medium (e.g., paper) handling options, or devices, that perform various functions such as, for example, providing for multiple paper input sources, multiple paper output destinations, duplexing (i.e., 2-sided printing on the media), stacking and collating. Such printer systems include a base printer having a printer controller, or print engine, including a microprocessor and associated electronic units. Control of the printer and paper-handling features of such a simple print system are handled by the print engine. As printer systems add a small number of optional devices, such as additional input sources, the control of the additional devices is provided by the print engine. For example, the printer option might have electronics to control portions of its own mechanism in which case the print engine controls the mechanism of the optional device directly through discrete electrical signals or via a unidirectional serial transmission, i.e., communications from the print engine to the device only. The printer engine controls the optional device directly with dedicated electrical signal lines used to turn a device motor on, turn the motor off, activate a device clutch, etc.

As printer systems become more complex, it is impractical for the print engine to directly control the entire printer system's electromechanical mechanism. Thus, printer systems have migrated to an architecture in which the printer acts as a "master" of "smart" or intelligent optional devices. Each intelligent optional device typically contains a microprocessor and associated electronics and microcode, to control its own electromechanical mechanism. The print engine, in turn, controls or manages the function of the optional devices as black boxes via a communications interface.

Various printers operate over a wide range of print speeds, thereby offering different levels of performance. The print media must be fed through the printer system at a rate, known as a process speed, which relates to the print speed of the printer.

It is known to design smart paper handling options such that a single option can accommodate any printer in a family of printers, each having different print speeds. Thus, a single smart paper handling option must be capable of feeding print media at various process speeds, each of which relates to the print speed of a respective printer in a family of printers.

For existing smart paper handling options, it is known to design the smart paper handling option to be capable of feeding print media at only a few possible process speeds, each of which relates to the print speed of a particular printer. A printer identifies itself, along with its process speed, to the smart paper handling option through a communication link and the smart paper handling option then selects which of its preprogrammed process speeds corresponds to the printer that is presently attached. The smart paper handling option includes a print medium transport assembly which includes a controller, motor and sensors which are capable of transporting a print medium at only one of the preprogrammed process speeds. A problem is that such smart paper handling options are not adaptable to printers having print speeds which do not correspond to any of the finite set of available process speeds within the smart paper handling option. Thus, in order to accommodate a new printer having a new print speed, an existing smart paper handling option must be removed and reworked or may even have to be scrapped and replaced with a newly designed smart paper handling options supporting the new printer's process speed(s). Each new family of printers having a new set of print engine speeds requires the rework of existing smart paper handling options or requires replacement with entirely new smart paper handling options in order to feed the print media at the correct speeds.

Existing smart paper handling options include look-up tables which provide control equations with fixed parameters corresponding to each of a finite number of discrete printer speeds. The control equations are used to drive the print medium transport assembly.

What is needed in the art is a method of relating in real-time a smart paper handling option process speed with any of a continuous range of print engine speeds, rather than with just a finite set of discrete print engine speeds.

SUMMARY OF THE INVENTION

The present invention provides a method of driving a print medium transport assembly of a smart paper handling option at any requested speed within a continuous range of possible speeds.

The invention is directed to, in one form thereof, a method of controlling a speed of a print medium through a printer, the method including the steps of providing a print medium transport assembly with a range of print medium transport speeds between a minimum print medium transport speed and a maximum print medium transport speed; providing a print engine with a print engine speed; dividing the range of print medium transport speeds into a plurality of subranges of print medium transport speeds; providing a requested speed to the print medium transport assembly which corresponds to the print engine speed; determining for each subrange an acceleration profile control equation, a constant speed control equation, and a deceleration profile control equation, wherein the constant speed control equation being dependent upon the requested speed; identifying one of the subranges of print medium transport speeds encompassing the requested speed; and transporting the print medium through the print medium transport assembly according to the acceleration profile control equation, the constant speed control equation, and the deceleration profile control equation associated with the selected subrange.

An advantage of the present invention is that smart paper handling options can support any speed within their motor systems dynamic range instead of a set of fixed speeds defined by currently released printers.

Another advantage is that the currently unknown speed operating points of future printers can be supported without requiring a microcode upgrade to the smart option.

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Figure 1:
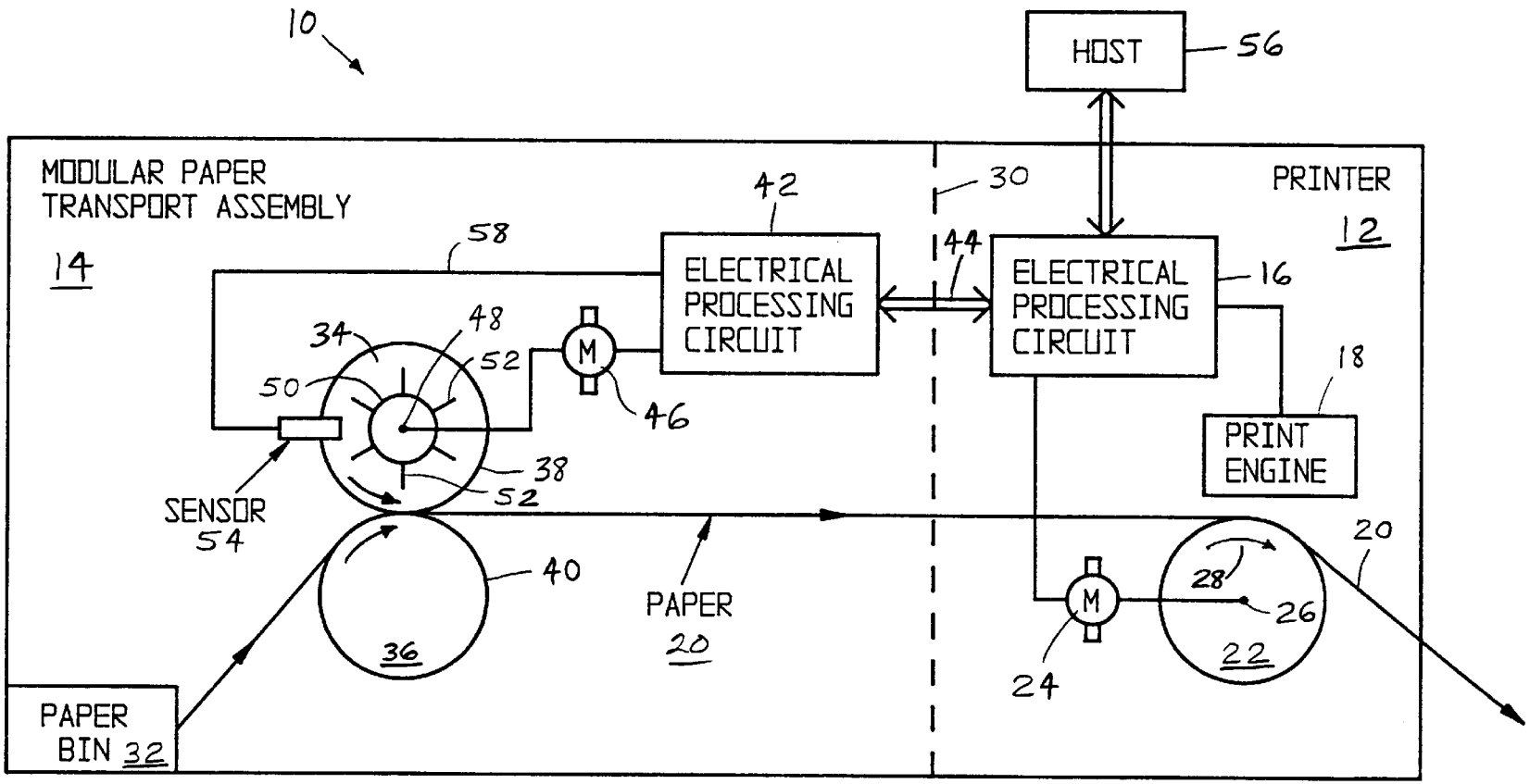
FIG. 1 is a simplified schematic diagram of a printer system of the present invention including a modular paper transport assembly attached to a printer.

Corresponding reference characters indicate corresponding parts throughout the several views. The exemplification(s) set out herein illustrate(s) one preferred embodiment of the invention, in one form, and such exemplification(s) (is)(are) not to be construed as limiting the scope of the invention in any manner.

DETAILED DESCRIPTION OF THE INVENTION

The present invention includes a method of enabling smart paper handling options to accommodate any print engine speed within a continuous range of possible speeds. Referring now to the drawings, and more particularly to FIG. 1, there is shown a schematic illustration of a printer system 10 including a printer 12 attached to a modular paper transport assembly 14 of a smart paper handling option.

Printer 12 includes an electrical processing circuit (EPC) 16 connected to a print engine 18. Print engine 18 projects the printed image onto paper 20 carried by a roll 22. EPC 16 is electrically connected to a motor 24 which drives or rotates roll 22 via an axle 26. As roll 22 rotates in the direction as indicated by arrow 28, it pulls paper 20 past print engine 18 and pushes paper 20 out of printer 12. The speed of paper 20 must have a very exact relationship with the rate of "imaging" by the print engine 18 in order for print engine 18 to produce the desired image on paper 20. Maintaining this exact relationship, EPC 16 closely regulates a print engine speed and/or the speed or roll 22. It is possible that print engine 18 may be only operable at one certain print engine speed with which EPC 16 must coordinate the rotational speed of roll 22.

Modular paper transport assembly 14 is attachable and detachable from printer 12, as indicated schematically at dotted line 30. Modular paper transport assembly 14 feeds paper 20 from paper bin 32 into printer 12. Two opposing rolls 34 and 36 pull paper 20 out of paper bin 32 and through a nip formed between rolls 34 and 36. The speed of paper 20 and the respective peripheral surfaces of rolls 34 and 36 are substantially equal. The speeds of rolls 34 and 36 must be coordinated with the speed of roll 22 such that the speed of paper 20 is substantially equal in modular paper transport assembly 14 and printer 12. Otherwise, either distortions of the image on the media, or damage to the media may occur. For example, roll 22 can tear paper 20 by pulling it too quickly, or roll 34 can crumble paper 20 by pushing it into printer 12 too quickly, either situation possibly resulting in a paper jam. Modular paper transport assembly 14 includes an electrical processing circuit (EPC) 42 which is electrically connected to EPC 16 through a communication link 44. Electrical processing circuit 42 is electrically connected to a motor 46 which drives or rotates roll 34 via an axle 48. Roll 34 includes a circumference 50, concentric with its peripheral surface 38, having a series of substantially equally spaced markers 52. A sensor 54 is located at a fixed sensing point adjacent circumference 50. Sensor 54 is configured to sense when a marker 52 passes by, and to transmit a signal indicative thereof to EPC 42.

Alternatively, spaced markers 52 could be an encoder disc mounted to the shaft of motor 46.

Also, alternatively, the modular paper transport assembly 14 could consist of an open loop motor system, such as a stepper motor system, in which spaced markers 52 and sensor 54 are NOT required. In such a system, a timer may be utilized to set the step rate for the stepper motor to control the rotational velocity of roll 34 to achieve the requested target speed of paper 20.

Figure 2:
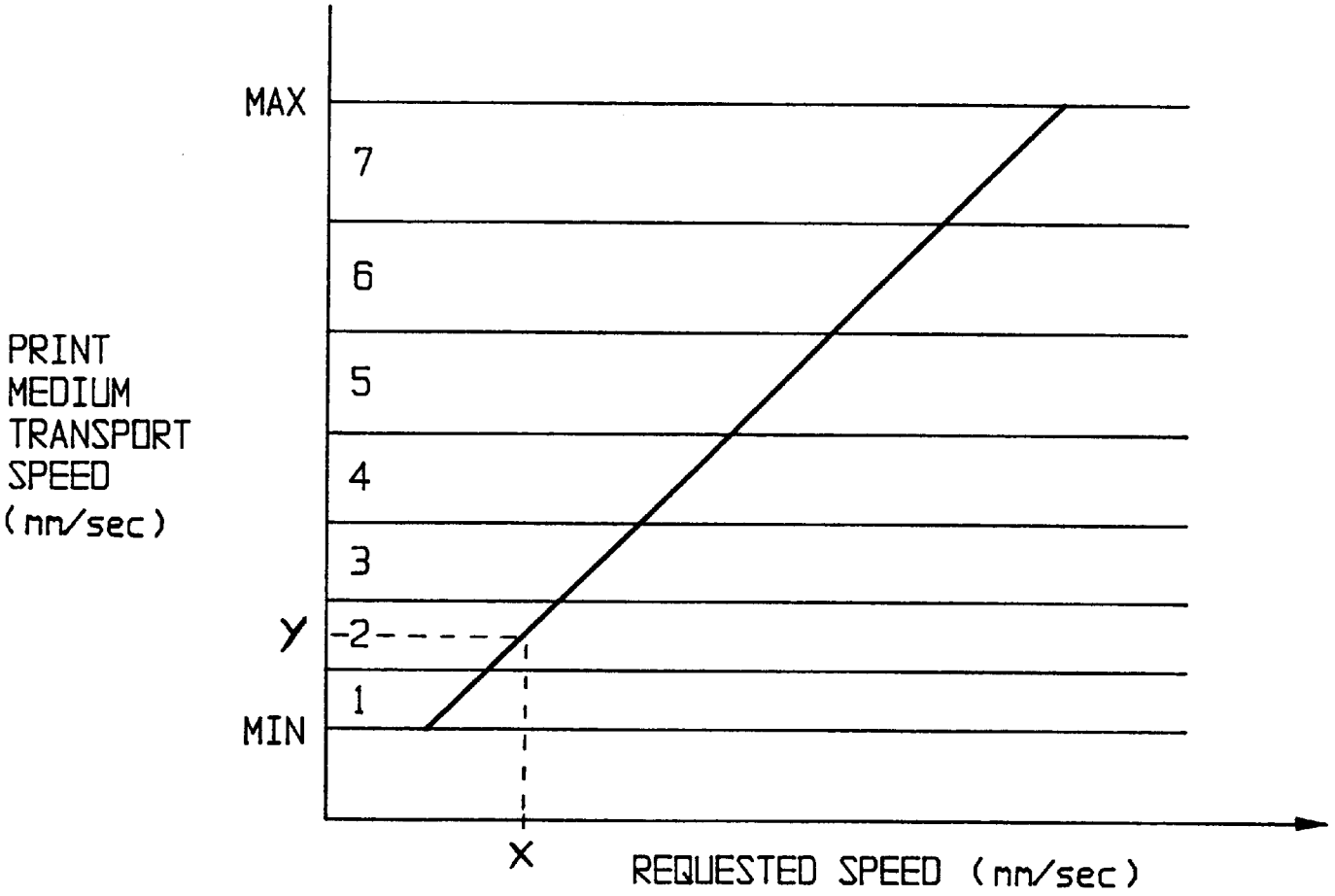
FIG. 2 is a plot of a continuous range of requested speeds versus corresponding subranges of print medium transport speeds.

During use, EPC 16 provides EPC 42 with a requested speed corresponding to the print engine speed of print engine 18. If print engine 18 is capable of operating at more than one speed, a host 56 electrically connected to EPC 16 may provide the requested speed (usually by the requested dots per inch, or resolution, that the print image is to be printed). Print engine 18 through EPC 16 then transmits to EPC 42 the required media transport speed. The requested speed may be in the form of a distance per unit time traveled by paper 20, a rotational speed of roll 22, a print engine speed expressed in characters per unit time, or the requested speed may be expressed in terms of some other units. Regardless of the units of which the requested speed is expressed, paper 20 will have an identifiable and corresponding speed through modular paper transport assembly 14, also known as a print medium transport speed. FIG. 2 illustrates the linear relationship between the requested speed from printer 12 and the print medium transport speed of paper 20 through modular paper transport assembly 14. Roll 34, will, of course, have an identifiable rotational speed which corresponds to any possible speed of paper 20. A reference rotational speed of roll 34 which corresponds to the requested speed is calculated by EPC 42. The print medium transport speed has a range of possible values, between a minimum and a maximum, depending upon the physical characteristics of modular paper transport assembly 14. The range of print medium transport speeds is divided into a number of subranges, each having a local minimum and a local maximum. In the embodiment illustrated in FIG. 2, the range of print medium transport speeds is divided into seven subranges. The subranges of print medium transport speed are sequentially adjacent to each other, i.e., the local maximum of subrange 4 is adjacent the local minimum of subrange 5 and the local minimum of subrange 4 is adjacent the local maximum of subrange 3.

Figure 3:
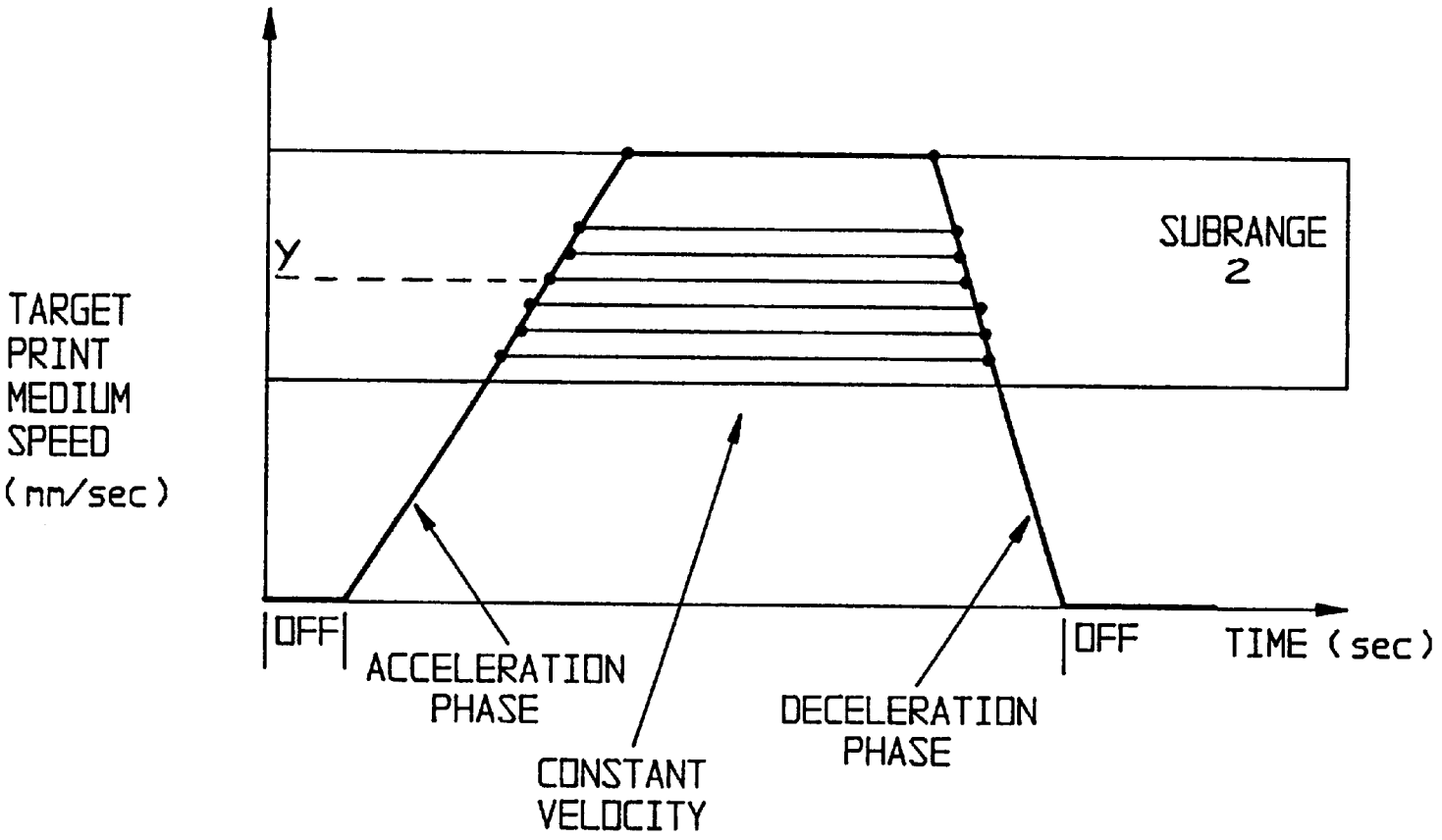
FIG. 3 is a print medium transport speed profile versus time for a given one of the subranges of FIG. 2.

For each requested speed, the corresponding and encompassing subrange of print medium transport speeds is identified by EPC 42, as illustrated by FIG. 2. For each print medium transport speed subrange, there is determined by EPC 42 an acceleration profile control equation, a constant speed control equation, and a deceleration profile control equation, as illustrated graphically in FIG. 3. The local minimum and maximum of each subrange as well as the three control equations can be determined off line and preprogrammed into EPC 42. An ideal acceleration profile control equation, constant speed control equation and deceleration profile control equation can be determined empirically for each subrange. The three control equations together define a continuum of target print medium speeds, each target print medium speed corresponding to a particular instant in time. Each requested speed corresponding to a given subrange has an identical acceleration profile control equation and an identical deceleration profile control equation. The constant speed control equation, however, is dependent upon and varies with each possible requested speed. Each target print medium speed represents a reference rotational speed of roll 34, and, in turn, a speed of paper 20 that corresponds to the the requested speed. The reference rotational speed calculated by relating the rotational speed of roll 34 to the speed of paper 20, can be used as a parameter in the constant speed control equation. For any requested speed falling within a given subrange, the rate of acceleration, as represented by the acceleration profile control equation, will be the same. After paper 20 has achieved the requested speed, the rotation of roll 34 is guided by the constant speed control equation which depends upon the requested speed. A number of constant speed control equations are illustrated in FIG. 3, each constant speed control equation corresponding to a different requested speed. Once printing has been completed, the rate of deceleration, as represented by the deceleration profile control equation, is the same for any requested speed within a given subrange. EPC 42 uses the three control equations to control the amount of power supplied to motor 46 with which to rotate roll 34.

Due to the precision required in matching the speed of paper 20 in modular paper transport assembly 14 to the speed of paper 20 in printer 12, it is desirable to regulate the speed of paper 20. The actual speed of paper 20 within modular paper transport assembly 14 can be determined by measuring the rotational speed of roll 34. To this end, a sensor 54 sends a signal to EPC 42 each time its senses the passing of a marker 52. From the time between these signals from sensor 54, EPC 42 can calculate the rotational speed of roll 34, and thus the speed of paper 20 in modular paper transport assembly 14. If this actual speed is not sufficiently close to the target print medium speed for that particular point in time, as illustrated in FIG. 3, then EPC 42 can adjust the power supplied to motor 46, thereby modifying the speed of paper 20 as needed. Such regulating of the speed of paper 20, including measuring, comparing and adjusting the paper speed, can occur during acceleration, constant speed or deceleration.

A width of a print medium transport speed subrange defined as the difference between a local maximum and a local minimum, can vary between the subranges. In FIG. 2, for example, the width of the subranges increases with speed.

Modular paper transport assembly 14 and printer 12 are shown as including two rolls and one roll, respectively. However, it is to be understood that either modular paper transport assembly 14 or printer 12 can include one roll or multiple rolls. Moreover, paper transporting mechanisms other than rolls may be used in either modular paper transport assembly 14 or printer 12. While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of controlling a speed of a print medium through a printer, said method comprising the steps of:

providing a print medium transport assembly with a range of print medium transport speeds between a minimum print medium transport speed and a maximum print medium transport speed;

providing a print engine with a print engine speed;

dividing said range of print medium transport speeds into a plurality of subranges of print medium transport speeds;

providing a requested speed to said print medium transport assembly which corresponds to said print engine speed;

determining for each said subrange an acceleration profile control equation, a constant speed control equation, and a deceleration profile control equation, said constant speed control equation being dependent upon said requested speed;

identifying one of said subranges of print medium transport speeds encompassing said requested speed; and transporting the print medium through said print medium transport assembly according to said acceleration profile control equation, said constant speed control equation, and said deceleration profile control equation associated with said selected subrange.

2. The method of claim 1, wherein said transporting step includes the substep of regulating the speed of the print medium.

3. The method of claim 2, wherein each of said acceleration profile control equation, and said constant speed control equation, and said deceleration profile control equation define a continuum of target print medium speeds, each said target print medium speed corresponding to a particular instant in time, said regulating substep including the substeps of:

determining the speed of the print medium;

comparing the speed of the print medium to a selected said target print medium speed; and adjusting the speed of the print medium based upon said comparing substep.

4. The method of claim 3, wherein said selected target print medium speed is achieved during one of acceleration, constant speed and deceleration.

5. The method of claim 3, wherein said print medium transport assembly includes a roll carrying the print medium, said roll having a rotational speed substantially proportional to the speed of the print medium.

6. The method of claim 5, wherein said regulating substep includes the substeps of:

calculating a reference rotational speed of the roll corresponding to said requested speed; and using said reference rotational speed as a parameter in said constant speed control equation.

7. The method of claim 6, wherein the roll includes a circumference and a plurality of markers substantially equally spaced around said circumference, said measuring substep including the substep of ascertaining a period of time between two adjacent said markers passing a fixed sensing point associated with said circumference.

8. The method of claim 6, wherein a plurality of markers are positions at substantially equal spacing about an axis of rotation of a rotatable shaft, and said measuring substep includes the substep of ascertaining a period of time between two adjacent markers.

9. The method of claim 2, wherein each of said acceleration profile control equation, said constant speed control equation, and said deceleration profile control equation define a continuum of target print medium speeds, each said target print medium speed corresponding to a particular instant in time, said regulating substep including the substeps of:

determining the speed of the print medium; and controlling the speed of the print medium based upon a requested speed.

10. The method of claim 9, wherein a selected target print medium speed is achieved during one of acceleration, constant speed and deceleration.

11. The method of claim 9, wherein said print medium transport assembly includes a roll carrying the print medium, said roll having a rotational speed substantially proportional to the speed of the print medium.

12. The method of claim 1, wherein said determining step is performed empirically.

13. The method of claim 1, wherein said determining step is performed analytically.

14. The method of claim 1, wherein said determining step is performed empirically and analytically.

15. The method of claim 1, wherein each said print medium transport speed subrange is defined by a local minimum print medium transport speed and a local maximum print medium transport speed, a difference between said local minimum print medium transport speed and said local maximum print medium transport speed varying between said subranges of print medium transport speeds.

16. The method of claim 1, wherein the printer is connected to a host, said requested speed being provided by said print engine.

17. The method of claim 1, wherein said print medium transport assembly is modularly attachable and detachable from the printer.

18. The method of claim 1, wherein said subranges of print medium transport speeds are sequentially adjacent to each other.

19. The method of claim 1, wherein said determining step comprises the steps of calculating in real-time components of said acceleration profile control equation, said constant speed control equation and said deceleration profile control equation based upon said requested speed.

* * * * *